United States Patent [19]

Furukawa

[11] Patent Number: 4,695,822

[45] Date of Patent: Sep. 22, 1987

[54] OVERHEAT WARNING AND PREVENTION SYSTEM FOR OUTBOARD ENGINES

[75] Inventor: Naoki Furukawa, Shizuoka, Japan

[73] Assignee: Yamaha Hatsudoki Kabushiki Kaisha, Iwata, Japan

[21] Appl. No.: 343,837

[22] Filed: Jan. 29, 1982

[30] Foreign Application Priority Data

Feb. 6, 1981 [JP] Japan ..... 56-16371

[51] Int. Cl.[4] ..... G08B 21/00; F02B 9/00

[52] U.S. Cl. ..... 340/53; 123/335; 340/57; 340/60; 340/522

[58] Field of Search ..... 340/52 F, 53, 60, 57, 340/522; 123/335, 198 DL

[56] References Cited

U.S. PATENT DOCUMENTS

| | | | |
|---|---|---|---|
| 1,968,828 | 8/1934 | Hardison | 340/57 |
| 3,302,171 | 1/1967 | Sensing | 340/57 |
| 3,634,881 | 1/1972 | Cline | 340/52 F |
| 3,738,346 | 6/1973 | Goodman | 340/53 |
| 3,782,358 | 1/1974 | Lenz | 123/198 DC |
| 3,884,203 | 5/1975 | Cliffgard | 123/198 DC |
| 3,893,108 | 7/1975 | McBride, Jr. et al. | 340/57 |
| 4,074,672 | 2/1978 | La Due et al. | 123/198 DC |
| 4,136,329 | 1/1979 | Trobert | 340/53 |
| 4,218,998 | 8/1980 | Hill et al. | 123/198 DC |

*Primary Examiner*—Glen R. Swann, III

*Attorney, Agent, or Firm*—Donald D. Mon; David O'Reilly

[57] ABSTRACT

A water pump circulates cooling water to an outboard engine, and overheating does not generally occur unless the circulation is insufficient. A pressure sensor responsive to low pressures so as to actuate an alarm, except when the engine RPM are at or below a selected level, such as those corresponding to a trawling operation where an alarm would be bothersome. A temperature sensor can be provided to stop the engine or reduce its output in the event that the engine temperature exceeds a selected temperature.

7 Claims, 6 Drawing Figures

OVERHEAT WARNING AND PREVENTION SYSTEM FOR OUTBOARD ENGINES

FIELD OF THE INVENTION

This invention relates to the warning and prevention of overheating in water-cooled engines, especially of outboard marine engines.

BACKGROUND OF THE INVENTION

A water-cooled outboard engine is customarily equipped for an overheat preventing device with a temperature sensor for detecting the temperature of the engine so that, when the engine temperature exceeds a predetermined level, the temperature sensor operates a warning device such as a buzzer. However, the overheat preventing device of the prior art has the disadvantage that seizure of the engine has often started when the warning device is operated, (although this depends upon the preset temperature of the temperature sensor), and that the overheating of the engine proceeds in case the warning sound of the buzzer has not been heard or heeded.

Therefore, there has been proposed an improved system, as disclosed in Japanese Patent Application No. 55-49306 and U.S. patent application Ser. No. 249,713, filed Mar. 31, 1981. According to this improved system, based upon the observation that overheating of the engine is caused by an insufficient supply of the cooling water, when the pressure of the cooling water becomes lower than a predetermined level, overheat is detected by a water pressure sensor which actuates a warning device. Also, when the engine temperature becomes higher than a predetermined level, this fact is detected by a temperature sensor which actuates means automatically to stop the engine.

According to the aforementioned system, however, because the water pressure sensor operates the buzzer when the pressure of the cooling water is lower than the predetermined level, the buzzer generates its warning sound even during a low output and slow running operation of the engine such as the idling operation or the trawling navigation, for example, because the water pressure is low as a consequence of the fact that the RPM of the cooling water pump is low. The continuous sound of the buzzer during the trawling navigation is discordant, although the sound during idling operation can be endured. Therefore, the operating pressure of the water pressure sensor has to be set lower than the highest idling pressure, and this is quite low.

In case such low pressure is used as the operating pressure of the water pressure sensor, the engine overheat has usually already proceeded to a considerable extent when the water pressure sensor actuates the alarm when the water pressure is low as the consequence that the inlet or conduit of the cooling water is clogged, or the cooling water pump malfunctions during high speed running operation. As a reuslt, at the time when the water pressure sensor operates, the temperature sensor also operates, thereby affording no time after the buzzer sounds before the engine is stopped. This invites the concern that the engine will be stopped without taking any countermeasure by looking for the cause of the drop in water pressure, and correcting that cause.

BRIEF DESCRIPTION OF THE INVENTION

The present invention has been conceived in view of the background thus far described, and contemplates to provide an overheat preventing system for a water-cooled engine in which protection against engine overheating is enhanced by raising the operating pressure of a water pressure sensor thereby to extend the intervening time after a warning device has operated before a temperature sensor operates, and in which the water pressure sensor is held inoperative during slow running operation such as trawling navigation, thereby to eliminate discordant noise which serves no useful purpose.

BRIEF DESCRIPTION OF THE DRAWINGS

The present invention will now be described in connection with one embodiment thereof with reference to the accompanying drawings, in which.

DETAILED DESCRIPTION OF THE INVENTION

Figure 1:
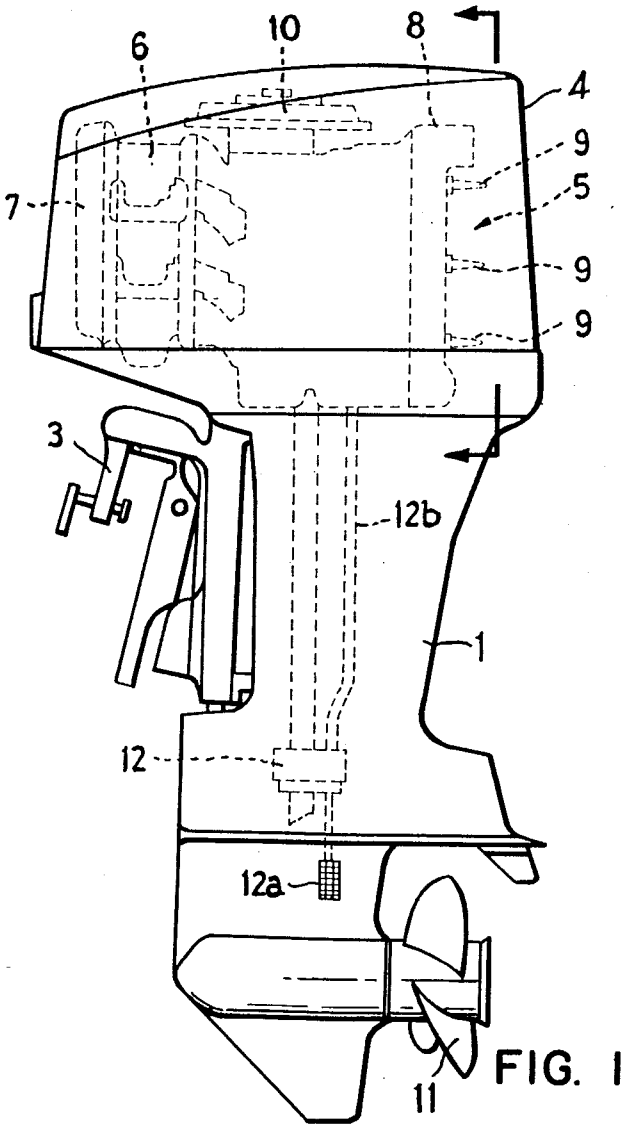
FIG. 1 is a side elevation showing an outboard engine.

FIG. 1 shows an outboard engine, in which reference numerals 1 and 2 indicate an upper casing and a lower casing, respectively. The upper casing 1 is attached through a bracket 3 to the transom (not shown) of a small vessel. To the upper end of upper casing 1, there is attached an engine cowling 4, in which an engine 5 is mounted. Engine 5 is a water-cooled type threecylinder engine which has its cylinders laid horizontally and arranged one above the other. Numeral 6 indicates carburetors which are attached to respective engine cylinders. They have their intake ends connected to a silencer 7, and their engine sides communicating through reed valves (not shown) with a crank chamber acting as a scavenging chamber. A cylinder head cover 8 has ignition plugs 9 attached to it. A fly-wheel magneto 10 is to be rotated by a crank-shaft. A propeller 11 is to be rotationally driven by engine 5. A water pump 12 is operative to pump brine or fresh water from the outside of the engine through a water inlet 12a, and to pump it to engine 5 through a feed pipe 12b. As a result, engine 5 is cooled by cooling water coming from water pump 12.

Figure 2:
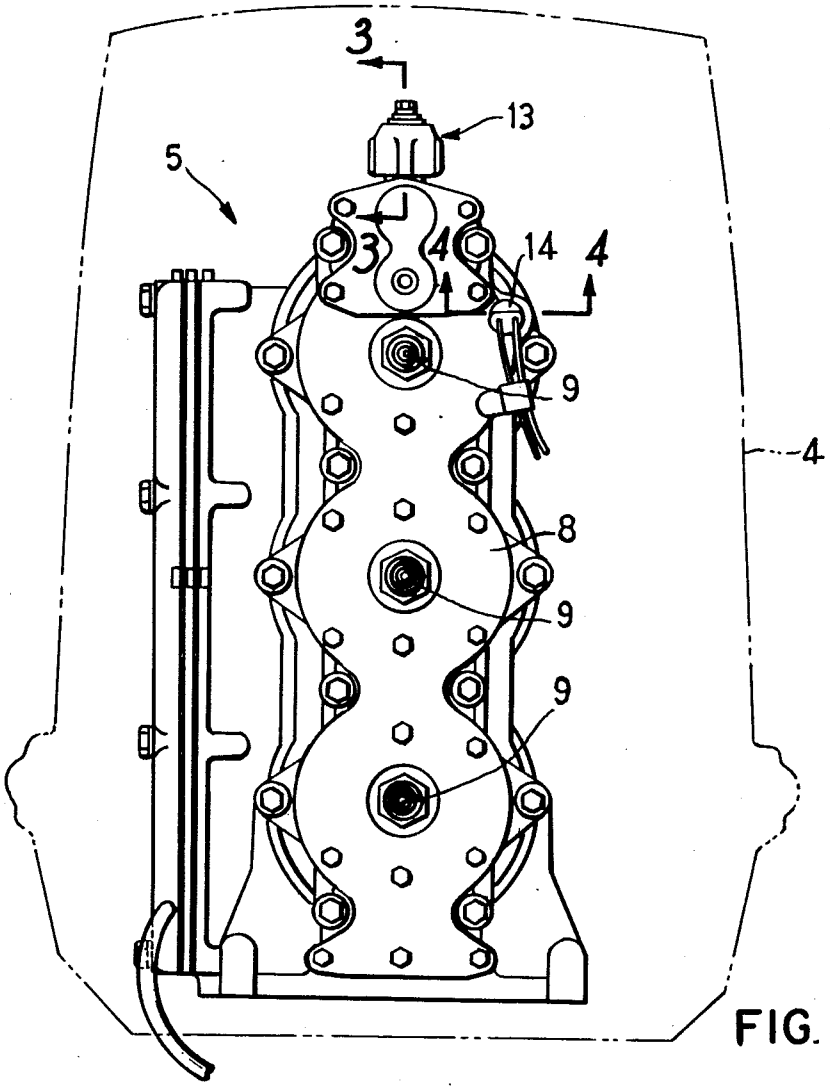
FIG. 2 is a section taken in direction of arrows 2—2 in FIG. 1.

To the aforementioned cylinder head cover 8, as shown in FIG. 2, there are attached a water pressure sensor 13 and a temperature sensor 14. Temperature sensor 14 to be used is well known in the art, and is commercially available.

Figure 3:
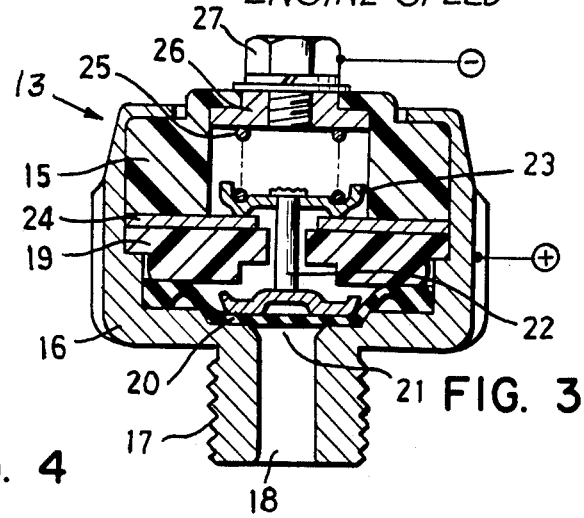

As shown in FIG. 3, water pressure sensor 13 has its base 15 made of an insulator and covered with a conducting cover 16. Conducting cover 16 is formed with a protruding threaded portion 17 which is to be screwed into cylinder head cover 8 and which is formed with a cooling water inlet 18. Cooling water inlet 18 comunicates with the water passage in cylinder head cover 8. An insulating spacer 19 is mounted in conducting cover 16, and a diaphragm 20 is watertight clamped between spacer 19 and cover 16. Diaphragm 20 defines a pressure chamber 21 which communicates with cooling water inlet 18. To diaphragm 20, there is connected an actuating rod 22, to which a movable contact plate 23 made of a conductor and providing a spring seat is integrally attached. Movable contact plate 23 is adapted to be brought into and out of contact with a stationary contact plate 24, clamped between the aforementioned base 15 and spacer 19, and made of a conducting material. Stationary contact plate 24 thus is electrically connected with cover 16. Against the aforementioned movable contact plate 23, there is made to abut one end of a coil spring 25 which has its other end abutting against a conducting spring seat 26. A bolt 27 is screwed into the spring seat 26.

Figure 6:
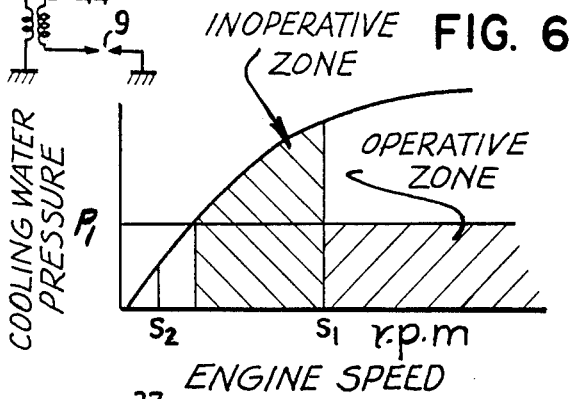
FIG. 6 is a graph illustrating the characteristics of the invention.

Thus, since the aforementioned water pressure sensor 13 is fed with cooling water in cylinder head cover 18 through cooling water inlet 18, movable contact plate 23 is urged to contact with stationary contact plate 24 by the action of coil spring 25 in case the pressure of the cooling water is zero. As a result, conduction is established between the conductive cover 16, which is made to conductively contact stationary contact plate 24, and spring seat 26 and bolt 27, which are electrically connected with movable contact plate 23 through coil spring 25, thus constructing a so-called "normally closed switch". When the cooling water pressure exceeds a predetermined level $P_1$ as is illustrated in FIG. 6, diaphragm 20 is pushed by that water pressure so that movable contact plate 23 is moved away from stationary contact plate 24 through the actuating rod 22 against the action of coil spring 25. As a result, the conduction between conducting cover 16 and bolt 27 is interrupted to create a so-called "switched-off state" or open circuit.

Figure 4:
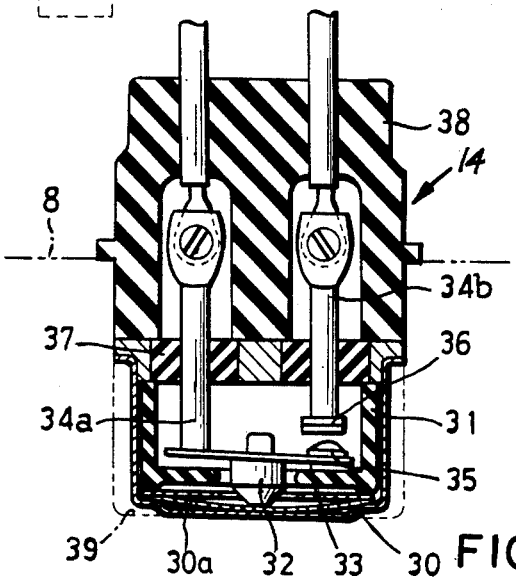
FIGS. 3 and 4 are sections taken along lines 3—3 and 4—4 in FIG. 2, respectively, showing the water pressure sensor and the temperature sensor.

Temperature sensor 14 is shown in FIG. 4. Specifically, a bottom case 30 is made of a thermal conductor and covers the bottom of an electrically insulating supporting base 31. In bottom case 30, there is accommodated a bimetal plate **30*a* which is made so operative to sense the temperature of the bottom case 30 that it warps back when the temperature sensed exceeds a predetermined level. Against the center portion of bimetal plate 30*a*, there is made to abut a push-up rod 32 having an upper end, to which a movable contact plate 33 is attached. This movable contact plate 33 has one of its ends attached so as always to make contact with one terminal 34*a*. Its other end carries a movable contact 35. This movable contact is so arranged to face a stationary contact 36, which is attached to the lower end of another terminal 34*b*, that it can be brought into and out of contact with stationary contact 36. As a result, when the bimetal plate 31 warps back in accordance with temperature rise, the push-up rod 32 is moved up. Then, movable contact plate 33 is deformed so that movable contact 35 is brought into contact with the stationary contact 36. Thus, conduction is established between terminals 34*a* and 34*b*. Therefore, the temperature sensor 14 thus far described is of the normally open type. An insulating cover 37 and an insulating cap 38 are shown. Temperature sensor 14 as thus far described is fitted in a mounting hole 39 formed in cylinder head cover 8 so that the lower side of the aforementioned bottom case 30 contacts the bottom of mounting hole 39. Thus, temperature sensor 14 senses the temperature of engine 5** so that it is actuated when the engine temperature reaches the predetermined level.

Figure 5:
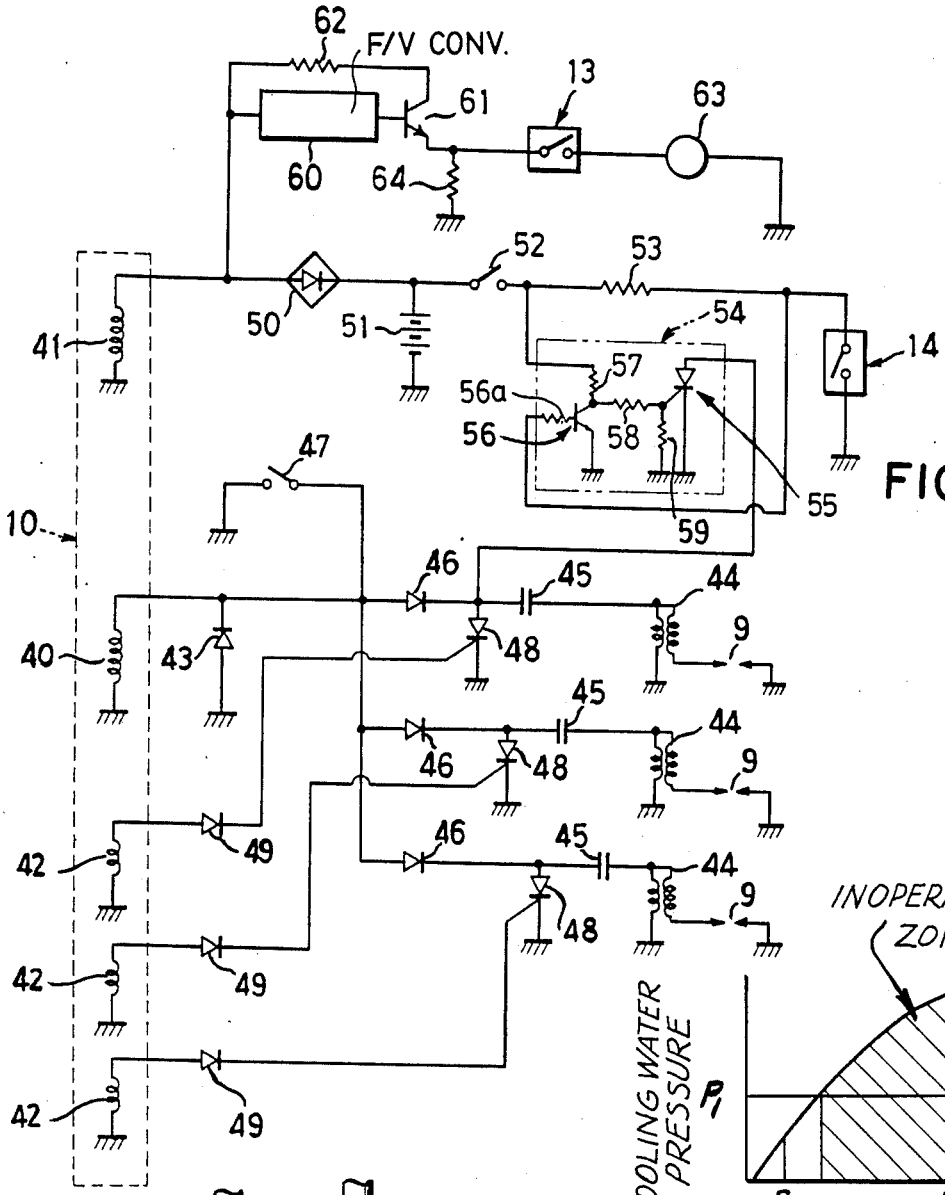
FIG. 5 is a circuit diagram.

Water pressure sensor 13 and temperature sensor 14 with the constructions thus far described are provided with circuit constructions as will now be described wtih reference to FIG. 5. Specifically, a charging coil 40, a lighting coil 41, and pulser coils 42 for generating ignition timing signals, are attached to fly-wheel magneto 10. A diode 43 is connected in parallel with charging coil 40, and ignition coils 44 are provided for respective engine cylinders. The nodes of the primary and secondary terminals of ignition coils 44 are respectively connected through capacitors 45 and diodes 46 to charging coil 40. Ignition plugs 9 of the respective engine cylinders are connected with the secondary terminals of respective ignition coils 44. A stop switch 47 is connected between the output terminal of charging coil 40 and ground. As a result, if stop switch 47 is closed when engine 5 is to be stopped, the output terminal of charging coil 40 is grounded to interrupt the charges of the respective capacitors 45 so that all ignition plugs 9 cease to spark, and engine 5 is stopped. Thyristors 48 are connected between respective capacitors 45 and diodes 46. The gates of respective thyristors 48 are connected through diodes 49 with the aforementioned pulser coils 42.

The ignition circuit thus far described is called a CDI (which is the abbreviation of "Capacitor Discharging Ignitor"), which is operative to rectify the output of the charging coil 40 by means of diodes 46, thereby to charge capacitors 45. Moreover, if the gate voltages generated by pulse coils 42 are applied with predetermined respective phase differences to respective thyristors 48, capacitors 45 are discharged to feed respective ignition coils 44 with electric currents so that sparks are generated at ignition plugs 9.

A diode bridge circuit 50 is operative to subject the a.c. output of lighting coil 41 to full-wave rectification. A battery 51 is connected with the output terminal of diode bridge circuit 50. With the anode of battery 51, there are connected in series a main switch 52, an auxiliary resistor 53, and the aforementioned temperature sensor 14.

A misfire circuit 54 is equipped with both a thyristor 55 for releasing the charge of one of the aforementioned capacitors 45 and an NPN transistor 56 for controlling the gate of that thyristor 55. Thyristor 55 has its anode connected between capacitor 45 and diode 46, and its cathode is grounded. On the other hand, NPN transistor 56 has its collector connected through resistors 57 and 58, respectively with the input terminal of resistor 53 and the gate of thyristor 55. The emitter of the NPN transistor 56 is grounded. Moreover, a bias resistor 59 is connected wtih the gate of thyristor 55. The base of NPN transistor 56 is connected through a resistor **56*a* between resistor 53 and temperature sensor 14**.

Thus, since the temperature sensor 14 is inoperative when the engine 5 is at a temperature lower than a predetermined level for its overheat state, the base current flows through the base of the transistor 56, if the main switch 52 is turned on, whereby to render transistor 56 conductive. As a result, thyristor 55 has its gate deenergized so that it remains non-conductive. As a result, sparks are normally generated at the ignition plugs 9 so that ignition plus 9 of the three engine cylinders operate in a predetermined sequence.

With the output terminal of the aforementioned lighting coil 41, on the other hand, there is connected an RPM detecting circuit such as a well-known F/V (i.e., frequency/voltage) converter 60 for detecting the RPM of the engine. F/V converter 60 is made operative to generate an electric signal when the RPM of engine 5 exceeds a predetermined level $S_1$, which is far higher than a low output and slow level (e.g., 650 RPM to 750 RPM) to be used for the trawling navigation, for example, 2500 RPM, as illustrated in FIG. 6. The aforementioned F/V converter 60 has its output terminal connected with the base of a transistor 61. The collector of transistor 61 is connected through a resistor 62 with the input terminal of the F/V converter 60. Moreover, the emitter of transistor 61 forms a series circuit together with the aforementioned water pressure sensor 13 and a buzzer 63 acting as a warning device. A resistor 64 is shown.

The operations of the embodiment having the construction thus far describd are as follows:

Water pressure sensor 13 as a switch is closed either when the engine is stopped or during idling and slow running operations, because it is closed unless the pressure of the cooling water of the engine 5 exceeds the predetermined level $P_1$. At the state in which the RPM of the engine exceeds level $S_2$ but fails to reach level $S_1$, however, since the F/V converter 60 generates no output signal, the transistor 61 is left non-conductive so that the buzzer 63 is left deenergized and generates no warning sound.

When the RPM of engine 5 is increased, the RPM of water pump 12 is also increased so that the cooling water pressure is raised. When the cooling water pressure exceeds level $P_1$, water pressure sensor 13 is turned off (i.e., as a switch it opens).

Moreover, when the RPM of engine 5 exceeds level $S_1$, F/V converter 60 detects this to generate its output signal. As a result, transistor 61 is rendered conductive. If the cooling water pressure is higher than level $P_1$, nevertheless water pressure sensor 13 is inoperative so that buzzer 63 is left deenergized and generates no warning sound. Now, if the pressure of the cooling water is caused to become lower than the level $P_1$ by the clogging of water inlet 12*a* or the feed pipe or by malfunctin of water pump 12, for example, notwithstanding that the RPM of engine 5 is higher than the level $S_1$, water pressure sensor 13 switch is closed. As a result, buzzer 63 is energized through transistor 61 and water pressure sensor 13 so that it generates its warning sound.

If this warning sound is left unattended, engine 5 will reach its overheated state. This overheat of engine 5 is detected by temperature sensor 14 so that the temperature sensor is turned on. Since transistor 56 has its base fed with no base current in response to the operation of temperature sensor 14, it is rendered conductive so that thyristor 55 is rendered non-conductive. As a result, the charge on capacitor 45 are released through thyristor 55 so that no current flows through ignition coil 44. In other words, ignition plug 9 of the single cylinder generates no sparks, whereas only the remaining cylinders generate their output powers. As a result, the overall output power and RPM of engine 5 are lowered. Also, because the aforementioned single cylinder has no combustion, the total heat liberation of engine 5 is reduced so that the temperature of engine 5 is gradually lowered.

If the temperature of engine 5 becomes lower than the predetermined level thereby to release the overheat state, temperature sensor 14 is turned off again, so that thyristor 55 of misfire circuit 54 is rendered non-conductive. As a result, ignition plug 9 of the single cylinder again generates a spark so that the full output power and RPM of engine 5 is resumed.

According to the embodiment thus far described, therefore, since buzzer 63 is held inoperative when the RPM of engine 5 is lower than level $S_1$ even if water pressure sensor 13 is turned on, it is not sounded to generate discordant sound during slow and low RPM operation such as trawling navigation. This means that the predetermined operating pressure level $P_1$ of water pressure sensor 13 can be made higher than that of earlier systems. Thus, if the predetermined operating pressure level $P_1$ of the water pressure sensor 13 is raised, it is possible to extend the time period after the buzzer 63 is sounded by the operation of the water pressure sensor 13 before the temperature of the engine 5 reaches its overheat level, i.e., before the temperature sensor 14 is operated. As a result, the safety can be enhanced, and it is possible to take counter-measures such as to search for the causes for the reduction in the pressure of the cooling water or to make repairs during the time period after the operation of the water pressure sensor 13 but before the operation of the temperature sensor 14.

In the embodiment thus far described, the ignition circuit of one cylinder is disabled by misfire circuit 54 when temperature sensor 14 operates, thereby to reduce the engine output power. However, the present invention is not to be limited to a misfire circuit 54, but may be so modified that the engine is stopped at the instant when the temperature sensor 14 operated. Moreover, it is also possible to separately provide such a warning device as can generate a warning signal in response to the operation of the temperature sensor 14. The term "buzzer" as used herein is used generically to connote any type of warning means, and is not to be limited to a simple buzzer.

Also, the present invention is not to be limited to outboard engines. As has been described in detail hereinbefore, according to the present invention, the water pressure sensor is ineffective when the RPM of the engine is lower than a predetermined level, by the action of the means for detecting the RPM. As a result, since the predetermined operating pressure of the water pressure sensor can be set at the high level, the elapsed time after the operation of the water pressure sensor before the operation of the temperature sensor can be so sufficiently retained that the safety can be enhanced and that either the causes for the reduction in the cooling water pressure can be sought for or the counter-measures can be taken. Moreover, since the water pressure sensor is left inoperative during a slow running operation, there can be attained an advantage that the warning signal is not offensive to the ear and eye.

This invention is not to be limited by the embodiment shown in the drawings and described in the description, which is given by way of example and not of limitation, but only in accordance with the scope of the appended claims.

I claim:

1. A system for warning of and preventing overheating of an engine of the type having coolant conduits through which coolant water under pressure is circulated to cool said engine comprising;

a plurality of cylinders in said engine, each of said cylinders having a spark plug;

low pressure-responsive sensor means exposed to and sensing said coolant water pressure;

engine RPM responsive means detecting the RPM of said engine and providing an output when said engine RPM is above a predetermined amount;

warning means connected to said low pressure-responsive sensor means and said engine RPM responsive means for providing a warning when said coolant water pressure is below a predetermined amount and said engine RPM is above a predetermined amount;

a high-temperature-responsive sensor exposed to said coolant water;

engine disabling means connected to said high-temperature responsive sensor adapted to partially disable said engine when said coolant water temperature exceeds a predetermined temperature; said engine disabling means interrupting an ignition spark to one or more of said spark plugs when said coolant water temperature exceeds a predetermined level and restoring said ignition spark to said one or more spark plugs when said coolant water temperature falls below said predetermined level;

whereby a warning is given when said coolant water pressure and RPM are such that overheating can occur and said engine disabling means provides reduced power output and engine RPM should overheating occur.

2. A system according to claim 1 in which said low-pressure-responsive sensor is a pressure-responsive electric switch, and in which said high temperature-responsive sensor is a temperature-responsive electric switch.

3. A system according to claim 2 in which said warning means comprises an electrically activated means for generating a sound.

4. A system according to claim 1 in which said engine disabling means prevents the ignition of all of said spark plugs, whereby to stop the operation of the engine at coolant temperatures at or above said predetermined temperature.

5. A system according to claim 4 in which said low-pressure-responsive sensor is a pressure-responsive electric switch, and in which said high temperature-responsive sensor is a temperature-responsive electric switch.

6. A system according to claim 5 in which said warning means comprises an electrically energized means for generating a sound.

7. A system according to claim 1 in which said engine speed responsive means is a frequency/voltage converter adapted to provide a disabling voltage at and above said predetermined level.

* * * * *